United States Patent [19]

Baughman et al.

[11] Patent Number: 4,941,020

[45] Date of Patent: Jul. 10, 1990

[54] TRANSFER APPARATUS HAVING VACUUM HOLES FOR HOLDING A RECEIVING SHEET

[75] Inventors: Richard C. Baughman, Geneseo; William Y. Fowlkes, Brockport; Bruce J. Rubin, Rochester; William B. Vreeland, Webster, all of N.Y.

[73] Assignee: Eastman Kodak Company, Rochester, N.Y.

[21] Appl. No.: 375,165

[22] Filed: Jul. 3, 1989

[51] Int. Cl.[5] ..... G03G 15/16

[52] U.S. Cl. ..... 355/275; 355/312

[58] Field of Search ..... 355/312, 275, 273, 271, 355/73, 76; 361/234

[56] References Cited

U.S. PATENT DOCUMENTS

| | | | |
|---|---|---|---|
| 3,633,543 | 1/1972 | Pitasi . | |
| 3,781,105 | 12/1973 | Meagher . | |
| 3,827,855 | 8/1974 | Blake | 355/312 X |
| 3,832,055 | 8/1974 | Hamaker . | |
| 3,900,591 | 8/1975 | Kline . | |
| 3,936,175 | 2/1976 | Jones | 355/273 X |
| 3,993,021 | 11/1976 | Kline | 355/275 X |
| 4,080,053 | 3/1978 | Friday . | |
| 4,403,847 | 9/1983 | Chrestensen . | |
| 4,550,999 | 11/1985 | Anderson | 355/312 X |
| 4,712,906 | 12/1987 | Bothner et al. . | |
| 4,724,458 | 2/1988 | Roy et al. | 355/312 X |

*Primary Examiner*—A. T. Grimley
*Assistant Examiner*—Sandra L. Hoffman
*Attorney, Agent, or Firm*—Leonard W. Treash

[57] ABSTRACT

Apparatus for transferring a toner image to a receiving sheet includes a transfer member with vacuum holes. To enhance the continuity of the transfer electric field, a conductive screen is placed on top of the vacuum holes. According to a preferred embodiment, the screen is conductive across the path of the receiving sheet, but insulative parallel to such path.

9 Claims, 4 Drawing Sheets

TRANSFER APPARATUS HAVING VACUUM HOLES FOR HOLDING A RECEIVING SHEET

RELATED APPLICATIONS

This application is related to co-assigned:

U.S. patent application Ser. No. 375,105, filed Jul. 3,1989. APPARATUS FOR TRANSFERRING TONER IMAGES TO A RECEIVING SHEET, William Y. Fowlkes et al.;

U.S. patent application Ser. No. 375,240. filed Jul. 3, 1989, TRANSFER APPARATUS HAVING A TRANSFER MEMBER WITH VACUUM MEANS, Marcus S. Bermel et al.; and U.S. patent application Ser. No. 375,110. filed Jul. 3,1989, TRANSFER APPARATUS HAVING VACUUM HOLES AND METHOD OF MAKING SUCH APPARATUS, Richard C. Baugham et al.

TECHNICAL FIELD

This invention relates to apparatus for transferring electrostatically held toner images to a receiving sheet. More specifically, this invention relates to such apparatus including a transfer roller or drum having vacuum holes or the like for holding the receiving sheet as it passes through transfer relation with a toner image.

BACKGROUND OF THE INVENTION

U.S. Pat. No. 4,712,906, Bothner et al., shows an electrophotographic color printer which forms consecutive images in different colors that are transferred in registry to a receiving sheet. The receiving sheet is wrapped on a transfer drum or roller and recirculated on the surface of the drum into transfer relation with the consecutive images to create a multicolor image on the sheets. To improve efficiency, large sheets, for example, "ledger" size sheets are placed on the drum with the small dimension parallel to the axis of the drum and wrapped substantially around the transfer drum. Small sheets, for example, "letter" size sheets are placed with their long dimension parallel to the axis of the drum. Since the short dimension of letter size sheets is approximately half the long dimension of ledger size sheets, two letter size sheets are placed on the drum in approximately the same space as the single ledger size sheet.

Prior to the Bothner invention, commercial color image transfer devices secured the receiving sheet to the transfer drum with small gripping fingers that grip the leading edge of the sheet. Many other methods are mentioned in the literature, for example, vacuum holes, electrostatics or various combinations of vacuum holes, electrostatics and gripping fingers. The gripping fingers were preferred commercially because they more firmly hold the sheet against slippage, which slippage would degrade the registration of the color images.

However, the Bothner invention is difficult to utilize with gripping fingers because the leading edge of the second letter size sheet is positioned at approximately the middle of a ledger size sheet. For some applications, retractable fingers may be made to work, but for many applications they would leave substantial image artifacts in a ledger size sheet. Bothner therefore suggests the use of vacuum holes which are positioned at the leading edge of each of the smaller sheets and may or may not both be activated for the ledger size sheet.

To firmly hold fairly heavy stock the holes were made as large as 3.6mm in diameter and placed less than one to a centimeter in a line across the drum.

The vacuum holes shown in Bothner work fine in many situations. However, under some conditions, the vacuum holes show up on the final image as small round areas of incomplete toner transfer. This is especially true in dry ambient conditions, with transparency receiving stock and with the second transfer to duplex receiving sheets where the receiving sheet has been dryed by a prior fusing step.

Even in dry conditions, the artifacts may be acceptable if they were confined to the leading edge of all sheets where image information is unlikely. However, the Bothner apparatus forces at least one line of vacuum holes for the leading edge of the second small sheet, to the middle of a large sheet. Further, in different sheet holding applications, it may be necessary to put vacuum holes at the trailing edge as well as the leading edge of at least some sheets. If a variety of sheet sizes is to be available, many lines of trailing edge holes will be necessary. Vacuum holes on the trailing edges of a variety of sheets place many lines of holes in the middle of larger sheets, depending on the mixture of sizes available in the machine.

U.S. Pat. No. 4,080,053, Friday, shows a vacuum web transport for a copy sheet through a transfer station having a rather lengthly transfer area formed by parallel portions of the transfer web and a photoconductive web. To prevent what the reference termed "vacuum hole printout", the effective position of the holes is gradually moved to different locations during passage through the transfer zone. Whatever the effectiveness of this solution for the apparatus shown, it would not be useful with the relatively small transfer zone formed by a transfer drum with either an image carrying web or drum.

The Bothner apparatus shows a transfer drum having an aluminum base with a polyrethane coating of intermediate conductivity. The layer of intermediate conductivity allows the creation of a relatively strong transfer electric field without electrical breakdown in the nip. It is believed that the failure to transfer toner over a vacuum hole is due to lack of continuity of the electric field in that region when a less conductive, for example, a dryed out transfer sheet is being used.

DISCLOSURE OF THE INVENTION

It is the object of the invention to provide an apparatus for transferring electrostatically held toner images to a receiving sheet, which receiving sheet is held by a vacuum to a transfer member, with a reduction of the aforementioned image defect associated with vacuum holes.

This and other objects are accomplished by positioning a screen over the vacuum holes, which screen has sufficient conductivity to maintain the continuity of the electrical field in the vicinity of the hole, but, being a screen, will not block the vacuum established through the holes.

According to one embodiment of the invention the screen can be a relatively conductive metal screen fully covering the transfer member. In this embodiment, the artifact due to the vacuum holes is completely eliminated. However, the screen causes the transfer member to act as a highly conductive transfer member. As such, it will provide reasonably good results in certain applications at relatively low voltages, say 1,000 volts.

However, other embodiments also eliminate the defect, while retaining some of the advantages of an intermediate conductivity drum. For example, it has been found that a unidirectionally conductive screen which is conductive only in a direction transverse to the direction of movement of the receiving sheet prevents the creation of the image defect but allows the drum to continue to function as though it were of intermediate conductivity.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
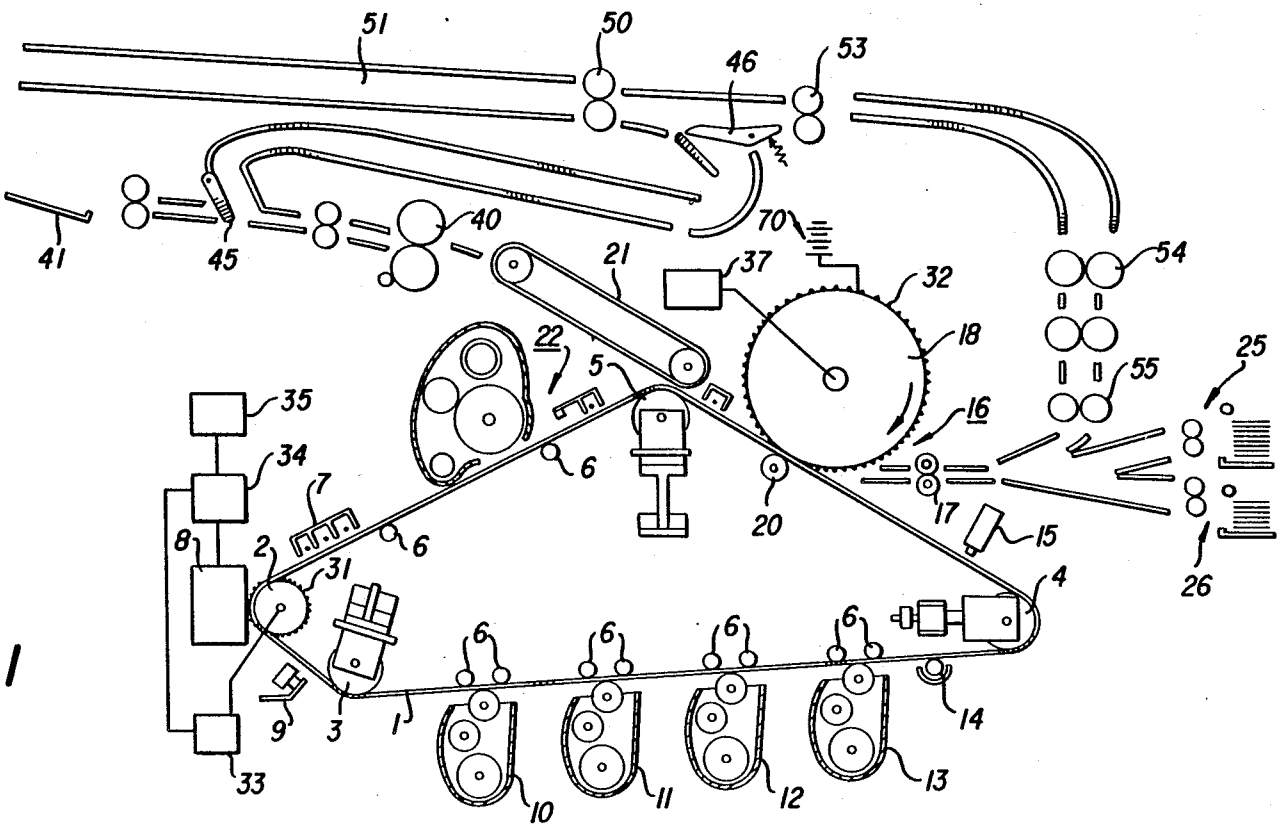
FIG. 1 is a schematic side view of a printer constructed according to the invention, with many parts eliminated for clarity of illustration.

According to FIG. 1 a film core portion of a copier or printer includes an image bearing member, for example, an endless electrophotoconductive web 1 entrained about a series of primary rollers 2, 3, 4 and 5, and other supporting structure, for example, film skis 6.

Web 1 is driven through a series of electrophotographic stations generally well-known in the art. More specifically, a uniform charge is laid down on the web 1 by a charging station 7. The uniformly charged web moves around printhead roller 2 which is directly opposite an LED printhead 8 which LED printhead exposes the web 1 in a manner well-known in the art. The art then moves into operative relation with an electrometer 9 which senses the level of a charge existing after exposure of the web by printhead 8, to help control the process.

The web then moves into operative relation with a series of toning or developing stations 10, 11, 12 and 13. Each image created by printhead 8 is toned by one of the toning stations. After being toned the web passes a magnetic scavenger 14 which removes excess iron particles picked up in the toning process. After the electrostatic image has been toned the web passes under a densitometer 15 which measures the density of the toner image also for use in controlling the process. The toner image then proceeds to a transfer station 16 where the image is transferred to a transfer surface of a receiving sheet carried by a transfer drum 18.

The transfer drum 18 includes vacuum holes 19 (FIGS. 2-3) for securing the receiving sheet thereto for repeated presentations to web 1. The transfer drum 18 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 70, compared to the conductive layer of the web 1 or to a backing roller 20 for the web. This process has been well-known in the art for many years, see for example, U.S. Pat. No. 3,702,482. Although either the web 1 or the drum 18 could be at ground, conventionally the conductive backing is at ground and the drum at a relatively high voltage. For example, if the toner to be transferred is positively charged, the drum can be biased to −3000V by electrical source 70.

As thoroughly discussed in U.S. Pat. No. 4,712,906, cited above, when the apparatus is operating in a multi-image mode, for example, a multicolor mode, consecutive images or pairs of images are toned with different colored toners using the different toning stations 10-13. These consecutive images are transferred in registry to the receiving sheet as it repeatedly is brought into transfer relation with the web 1 by the drum 18. After the transfer operation is complete, the receiving sheet is allowed to follow the web, for example, by removing the vacuum holding it to the drum 18 or by stripping the sheet with a skive, other conventional stripping mechanism, or both. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism all located at a cleaning station 22.

Figure 2:
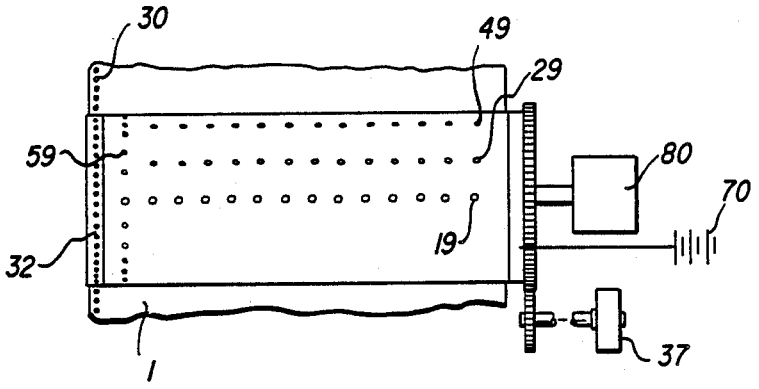
FIG. 2 is a top view of a portion of a transfer apparatus in which the invention is usable.

The transfer drum 18 is driven by a motor 37, the drum 18 in turn driving the web 1 through a sprocket 32 which engages perforations 30 (FIG. 2). The sprocket 32 also forms part of a registration and timing system which includes a sprocket 31 on printhead roller 2 which sprocket is linked to an encoder 33. The encoder 33 feeds signals indicative of the angular position of sprocket 31 to a drive 34 for the printhead 8 which drive 34 times the application of information from an information source 35 to the printhead 8.

After the receiving sheet leaves the fuser 40 it can go directly to an output tray 41 or be deflected by a deflector 45 into a duplex path according to the position of deflector 45, the position of which is controlled by the logic of the apparatus through means not shown. The duplex path moves the sheet by rollers and guides directing it first through a passive deflector 46 into turn-around rollers 50. Turn-around rollers 50 are independently driven to drive the receiving sheet into turn-around guide means 51 until the trailing edge thereof has been sensed by an appropriate sensor, not shown, to have passed passive diverter 46. Once the trailing edge has passed passive diverter 46 the turn-around rollers 50 are reversed and the receiving sheet is driven by rollers 50 and other sets of drive rollers 52, 53, and 54 back to a position upstream of the transfer station 16. The receiving sheet can pass through registration mechanisms for correcting for skew, crosstrack misalignment and in-track misalignment and ultimately stop at alignment rollers 55.

Transfer station 16 receives sheets from any of three sources. First, it can receive sheets of one particular size from a first supply 25, which first supply may include, for example, letter size sheets being fed with their short dimension parallel with the direction of feed. Second, it may receive sheets from a second supply 26, which, for example, may include ledger size sheets with their long dimension parallel to the direction of movement. Third, the transfer station 16 may receive sheets from the duplex path as controlled by rollers 55 which may include either size sheet and would already contain a fused image on its upper side. The receiving sheets from whatever source, stop against timing rollers 17. In response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes multiple sheets at one time depending on the length of the sheets. For example, four letter size sheets may be in the duplex path at one time or two ledger size sheets. If the printer is printing different images on different sheets, the logic and control of the apparatus must supply the necessary programming to the exposure and toning stations so that the sheets ultimately fed to the output tray 41 are in the correct order considering the number of sheets that must be in the duplex path. Such programming is known in the art, see, for example, U.S. Pat. No. 4,453,841.

Figure 3:
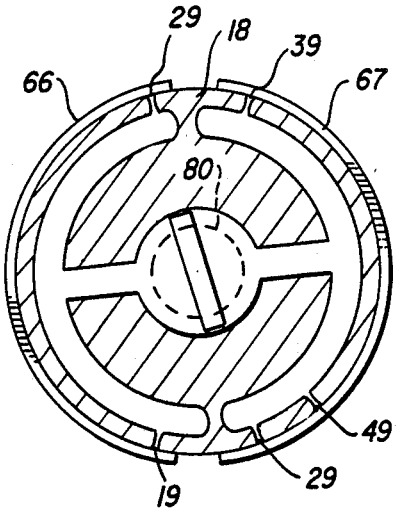
FIG. 3 is a side section of a transfer drum shown in FIG. 2.

Transfer drum 18 is best seen in FIGS. 2 and 3. According to FIG. 2, vacuum holes 19 are positioned across the length of drum 18 to grip the leading edge of a receiving sheet. Vacuum is applied to the holes from a source of vacuum, shown schematically at 80 through suitable conduits and valves, some of which are not shown. U.S. Pat. No. 4,712,906, cited above, is incorporated by reference herein and shows more details of a suitable mechanism for applying and releasing the vacuum at the appropriate times for the holes gripping the leading edges of receiving sheets.

The drum 18 has an aluminum core and a polyurethane outer layer or layers. Preferably, the polyurethane is of an intermediate conductivity, for example, it can have a resistivity of $5\times10^9$ ohm/cm. Transfer rolls having an intermediate conductivity outer layer or layers are well-known and have certain advantages. See, for example, U.S. Pat. No. 3,781,105, Meagher, issued Dec. 25, 1973.

As seen in FIG. 3, vacuum holes 19 grip the leading edge of a first letter sized receiving sheet 66 which encompasses slightly less than half the circumference of the drum 18. The leading edge of a second letter size sheet 67 is gripped by another row of vacuum holes 39. For many grades of paper, vacuum holes for the leading edge are adequate. However, for best holding of a wide grade of materials, including transparency stock, vacuum holes 29 located along the trailing edge of the sheets assist in the holding process, preventing creep of the receiving sheet on the drum surface and thereby preventing misregistration of images. Additionally, a set of vacuum holes 59 can be positioned along one or both lateral edges of the image areas to provide additional holding force.

If a ledger sized receiving sheet is to be used, the leading edge is still attached using vacuum holes 19 but, the sheet will stretch across one row of holes 29 and the row of holes 39 ending up short of the second row of holes 29. To secure the trailing edge of ledger sheets an additional row of holes 49 is provided. If the trailing edge of other sizes of sheets (for example, legal size) is to be secured, additional rows of holes will be necessary.

Thus even without the holes securing the trailing edges, at least one row of vacuum holes will lie underneath the primary image area during the transfer process of a ledger size sheet. With the additional rows of holes to secure the trailing edge of sheets, the number of holes is multiplied.

Under some conditions, the vacuum holes do not have an adverse effect on the final image. However, for many conditions, especially with a dry receiving sheet, for example, a sheet that has been through a fuser once and is now receiving the second side of a duplex copy or a resin sheet used to make a transparency, insufficient transfer is present in the portion of the sheet overlying the vacuum holes. This shows up on a white receiving sheet as a white spot in the image. This phenomena is believed to be due to the fact that transfer is accomplished primarily by a relatively strong electric field between the surface of the drum 18 and a conductive backing for the web 1. In a humid environment, the paper is more conductive and provides some continuity of the field over the holes. In dry conditions, the receiving sheet is less conductive and that field loses continuity over the holes. The toner does not transfer, staying on the surface of web 1.

According to the invention this problem is solved by covering the vacuum holes with a screen which is sufficiently conductive to improve the continuity of the field in the vincinity of the hole. Because it is a screen the vacuum may be maintained through it.

Figure 7:
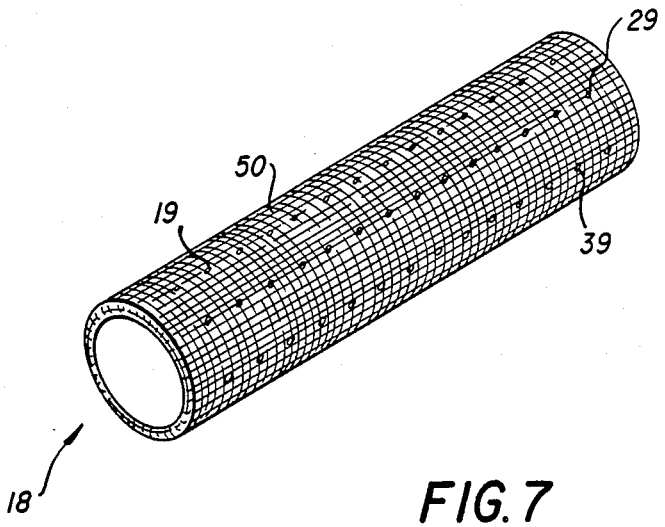
FIG. 7 is a perspective view of a drum constructed according to another embodiment of the invention.

FIGS. 7 shows the simpliest embodiment of the invention. According to FIG. 7, a stretch fabric screen 50 is fit over the entire drum. Because of the stretch characteristics, it adheres tight to the surface of the drum and presents to the transfer process a relatively rough surface but uniform surface which is quite conductive.

In the transfer process this screen completely hides the artifact and will permit holding of the receiving sheet to the drum using the vacuum created by the vacuum holes. However, the drum now reacts in the process as though it were conductive. Conductive drums have a tendency to create ionization problems in the transfer nip but are useful in relatively low voltage transfer applications of which there are some commercial uses. For example, good results are received with the structure shown in FIG. 7 using a conductive screen 50 using transfer voltages of 1,000 volts.

However, transfer fields that are much stronger can be used with a transfer drum that has a surface of intermediate conductivity. As described above, such drums commonly have a polyurethane outer layer bonded to an aluminum core. The normally insulative polyurethane has been treated with a conductive material to raise its conductivity so that it has a resistance of between $10^9$ and $10^{11}$ ohm/cm, for example, $5\times10^9$ ohm/cm. This material, as it travels through the nip is sufficiently conductive to permit the establishment of a substantial electric field between it and the backing of the member bearing the toner image to be transferred. However, it is not so conductive that serious ionization problems and electrical breakdown is caused in the nip at voltages substantially higher than usable with a more conductive drum. If a drum such as this having an outer layer of intermediate conductivity is covered by a conductive screen such as screen 50 in FIG. 7, the drum becomes a fully conductive drum in the transfer process and will not support the higher transfer voltages preferred.

According to a preferred embodiment of the invention we have found several approaches which reduce this ionization problem. One is to make the screen 50 with conductive strands running transverse to the direction of movement of the drum surface (the cross-track direction), i.e., generally parallel to the axis of the drum and non-conductive strands running parallel such direction of movement (the in-track direction). With this structure any line in the surface of the drum which line is transverse to the direction of movement has the same potential and is isolated from each other similar line. Ionization becomes considerably less of a problem and higher voltages can be maintained.

A second solution is to make the screen of a material having intermediate conductivity itself. For example, the screen can be made of a commercially available nylon-carbon combination which is coated with an aminosilane having intermediate conductivity and providing a screen with a resistivity of approximately $10^9$ ohm/cm. With such structure higher transfer voltages can be maintained without the vacuum hole artifact.

The two approches can be combined by coating the unidirectional screen with an intermediate conductivity material to provide still less likelihood of electrical breakdown.

Figure 4:
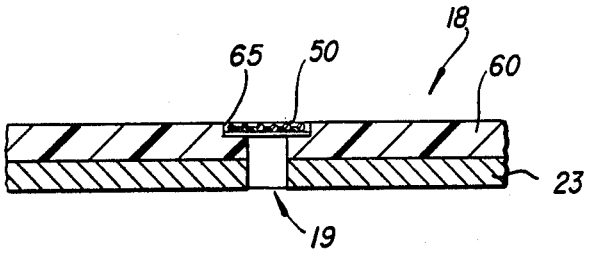
FIG. 4 is a side section of a portion of a transfer drum through a vacuum hole constructed according to the invention.
Figure 5:
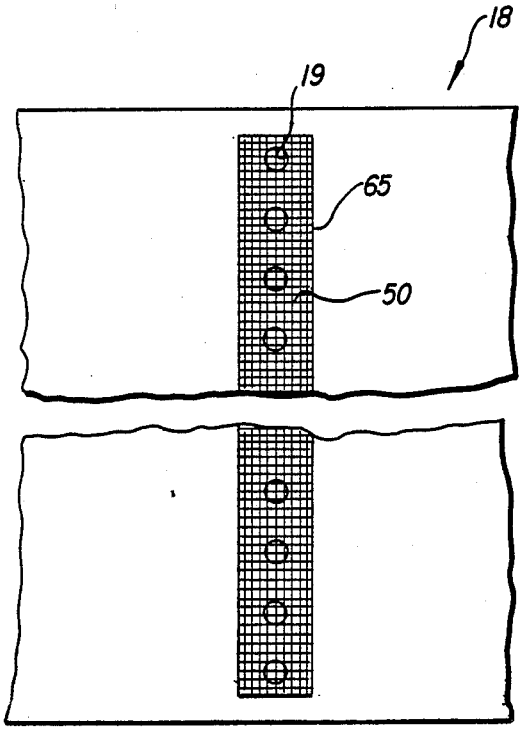
FIG. 5 is a top view of the portion of the drum shown in FIG. 4.
Figure 6:
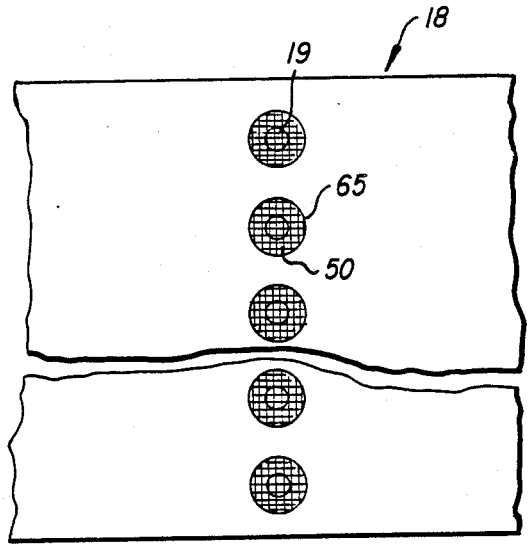
FIG. 6 is a top view of another embodiment similar to that shown in FIG. 5.

According to FIGS. 4, 5 and 6, the screen material need not fully encompass drum 18. It can be positioned over only the holes themselves. According to FIGS. 4 and 5, vacuum holes 19 which may be, for example, 2 to 6mm in diameter are drilled through the polyurethane outer layer 60 and aluminum core 23. At the surface of outer layer 60 a shallow recess 65 is provided which can be local to each individual hole as shown FIG. 6 or stretch across more than one hole, for example, an entire row of holes as shown in FIG. 5. Screen material 50 is positioned in recess 65. With the recess 65 the screen 50 has a less harmful effect on the uniformity of the surface of layer 60.

If the FIG. 6 structure is used, and the recess 65 is made only barely larger than the hole 19, fully conductive screen material can be used at higher voltages than in FIG. 7 embodiment. However, it is still preferable in FIGS. 4, 5 and 6 embodiments to use a screen that is conductive across the roller but insulative with the roller, that is of intermediate conductivity or both.

A strictly unidimensional screen can be made by wrapping the screen using a filament winding of intermediate conductivity with the winding going helically around the drum. Care must be taken to provide enough spacing between the filaments to maintain the vacuum. This approach has manufacturing advantages, because the filament winding art is well developed.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for transferring a toner image from an image-bearing member to a receiving sheet, which apparatus includes:

a transfer drum having a conductive surface and having vacuum holes to said surface, means for applying a vacuum to said vacuum holes to hold a receiving sheet on the surface of the transfer drum, means for creating an electric field urging a toner image toward said transfer drum, and a screen positioned across the top of each of said vacuum holes which screen is sufficiently conductive to improve the continuity of the electric field in the vicinity of the vacuum hole, said screen having fibers which run in a direction generally parallel to the axis of the drum which are sufficiently conductive to improve the continuity of the transfer field and fibers running around the surface of the drum which are sufficiently insulative to reduce the tendency for ionization in a transfer nip created by the drum and the image-bearing member.

2. Apparatus according to claim 1 wherein said transfer member is a drum.

3. Apparatus according to claim 1 wherein said fibers runninng parallel to the axis of the drum have a resistivity between $10^9$ and $10^{11}$ ohms/cm.

4. Apparatus for transferring a toner image from an image-bearing member to a receiving sheet, which apparatus includes:

a transfer member having a conductive surface, having vacuum holes to said surface and a recess around said vacuum holes, means for applying a vacuum to said vacuum holes to hold a receiving sheet on the surface of the transfer member, means for creating an electric field urging a toner image toward said tranfer member, and a screen positioned in said recess across the top of each of said vacuum holes which screen is sufficiently conductive to improve the continuity of the electric field in the vicinity of the vacuum hole.

5. Apparatus according to claim 4 wherein said recess is formed locally around each of said vacuum holes.

6. Apparatus according to claim 4 wherein said recess surrounds a plurality of said vacuum holes.

7. Apparatus according to claim 4 wherein said screen has fibers which have a resistivity between $10^9$ and $10^{11}$ ohms/cm.

8. Apparatus according to claim 4 wherein said screen is of similar conductivity to said conductive surface, and wherein said conductive surface has a resistivity between $10^9$ and $10^{11}$ ohms/cm.

9. Apparatus for transferring a toner image from an image-bearing member to a receiving sheet, which apparatus includes:

a transfer member having a conductive surface having a resistance between $10^9$ and $10^{11}$ ohms/cm and having vacumm holes to said surface, means for applying a vacuum to said vacuum holes to hold a receiving sheet on the surface of the transfer member, means for creating an electric field urging a toner image toward said transfer member, and a screen positioned across the top of each of said vacuum holes which screen has a conductivity between $10^9$ and $10^{11}$ ohms/cm and is sufficiently conductive to improve the continuity of the electric field in the vicinity of the vacuum hole.

* * * * *